US005267840A

United States Patent [19]

Snow et al.

[11] Patent Number: 5,267,840

[45] Date of Patent: Dec. 7, 1993

[54] POWER STEERING PUMP WITH BALANCED PORTING

[75] Inventors: Douglas G. Snow, Walled Lake; Ralph Romano, Brighton; Jerry L. Wilson, Farmington; George C. Farrar, Redford Township, Wayne County, all of Mich.

[73] Assignee: Deco-Grand, Inc., Royal Oak, Mich.

[21] Appl. No.: 753,755

[22] Filed: Sep. 3, 1991

[51] Int. Cl.[5] ..... F04B 49/00

[52] U.S. Cl. ..... 417/310

[58] Field of Search ..... 417/310; 418/131, 266, 418/267, 268

[56] References Cited

U.S. PATENT DOCUMENTS

| | | | |
|---|---|---|---|
| 2,856,861 | 10/1958 | Adams et al. . | |
| 2,910,944 | 11/1959 | Pettibone | 417/310 |
| 3,386,648 | 6/1968 | Van Rossem . | |
| 3,645,647 | 2/1972 | Clampa et al. | 417/310 |
| 3,788,783 | 1/1974 | Rosaen | 418/108 |
| 4,408,964 | 10/1983 | Mochizuki et al. | 417/310 |
| 4,470,764 | 9/1984 | Anderson et al. | 417/299 |
| 4,470,766 | 9/1984 | Masica et al. | 417/310 |
| 4,470,768 | 9/1984 | Konz | 417/310 |
| 4,473,341 | 9/1984 | Ohe et al. | 417/299 |
| 4,505,655 | 3/1985 | Honaga et al. | 418/133 |
| 4,538,966 | 9/1985 | Nikaido | 417/286 |
| 4,538,976 | 9/1985 | Shibuya | 418/133 |
| 4,573,890 | 3/1986 | Hadama et al. | 418/108 |
| 4,621,986 | 11/1986 | Sudo | 417/304 |
| 4,772,190 | 9/1988 | Merz et al. | 418/133 |
| 4,804,317 | 2/1989 | Smart et al. | 418/133 |
| 4,838,767 | 6/1989 | Ohe et al. | 417/299 |
| 4,842,500 | 6/1989 | Fujie et al. | 418/133 |

OTHER PUBLICATIONS

1960–1963 Vickers Corp. Jet fuel pump Model No. 4V317L003 (shown in four photographs and two sketches).

Sperry Vickers Industrial Hydraulics Manual, Sep. 1970, pp. 6–9 and pp. 11–21.

Vickers Mobile Hydraulics Manual M-2990-S, First Ed. 1967, pp. 24–53, edited by Basal.

Sperry Vane Pump Motor Design Guide, 1976, pp. 1, 2–6, 83–84.

*Primary Examiner*—Richard A. Bertsch

*Assistant Examiner*—Alfred Basichas

*Attorney, Agent, or Firm*—Harness, Dickey & Pierce

[57] ABSTRACT

A balanced vane hydraulic pump designed for automotive power steering applications employs a multi-vane rotor and cam ring. The pump has a three-piece aluminum housing construction, with the flow regulating valve located in the rear housing section, the cam ring and rotor located in the center housing section, and a two bearing sets located in the front housing section for supporting the pump drive shaft from one end only. The rear housing section also preferably includes a semi-flexible inner wall which under high pressure conditions bows inwardly toward the cam ring, rotor and vanes, thereby helping to maintain operating clearances so as to relatively help control leakage under varying pump output pressures, even though separate pressure and thrust plates are not used. An important feature of the pump is the use of hydraulically balanced low pressure and high pressure passageways which are contoured to efficiently direct the moving fluid and to minimize energy loss within the pump passageways, which enhances speed capabilities. The low pressure fluid passageways are in particular balanced through the use of a generally symmetrical wishbone gallery in the center housing section which feeds low pressure hydraulic fluid to two pairs of two diametrically opposed inlet windows adjacent to the low pressure inlet sectors of the cam ring.

19 Claims, 7 Drawing Sheets

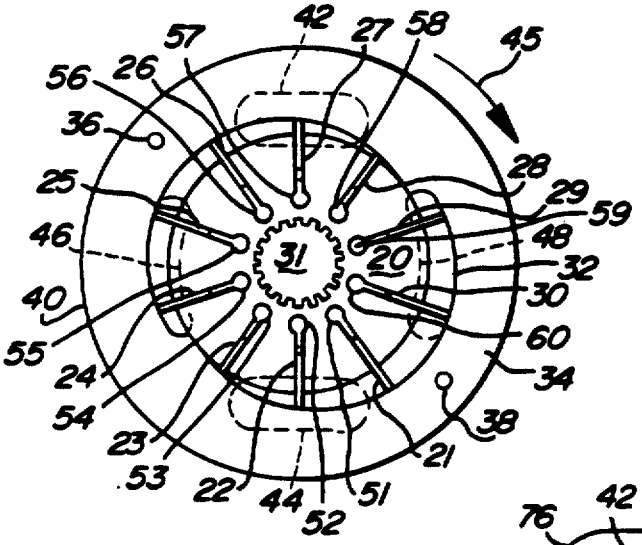
Fig-1
PRIOR ART
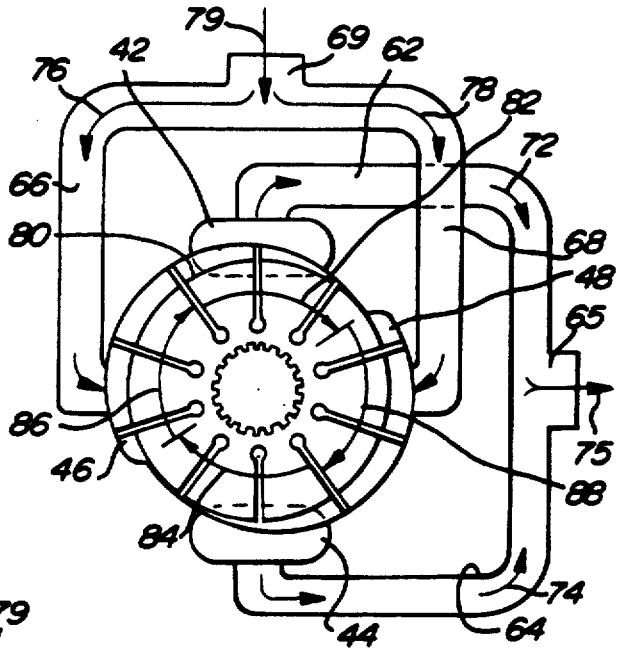
Fig-2
PRIOR ART
Fig-3
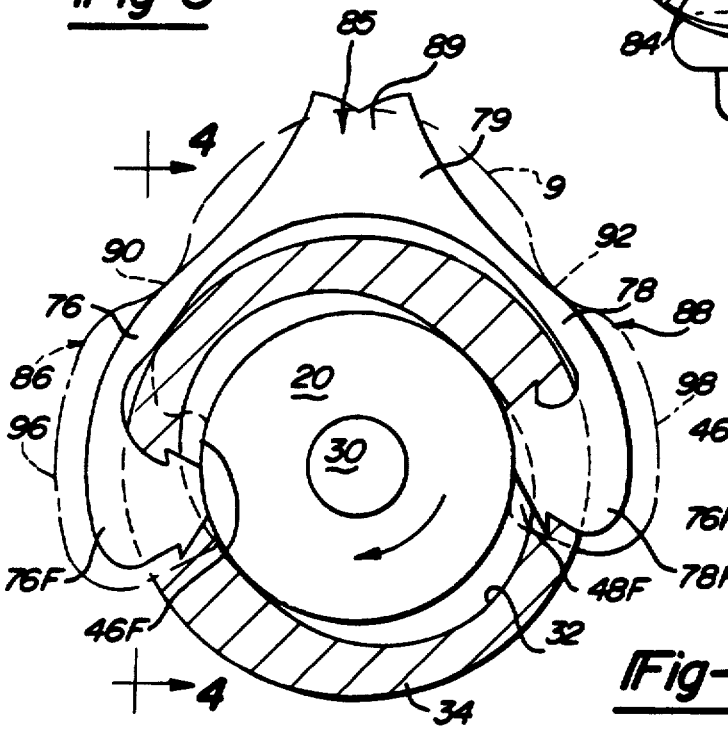
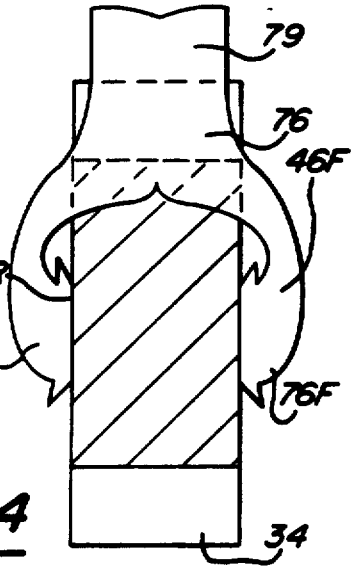
Fig-4

POWER STEERING PUMP WITH BALANCED PORTING

BACKGROUND OF THE INVENTION

1. Field of the Invention

The present invention relates in general to balanced vane hydraulic pumps, and in particular to power steering pumps of the balanced vane type for use in automotive or mobile equipment applications.

2. Description of Related Art

Conventional balanced vane hydraulic pumps used in power steering applications have a generally cylindrical steel rotor with multiple vanes rotating within an oval path that is machined into a powdered iron cam ring. This mechanical arrangement is shown in simplified form in FIG. 1, where the rotor 20 has ten vanes 21-30 which rotate under power provided through a splined drive shaft 31. The outer edges of the vanes 21-30 are generally beveled or otherwise sharpened to a straight edge, and follow the generally elliptical machined inner surface 32 of cam ring 34 which is held in place relative to the pump housing (not shown in FIG. 1) by locator pins 36 and 38. The outer shape 40 of cam ring 34 is normally cylindrical. The high pressure outlet ports or "windows" 42 and 44 are shown in dashed lines at the top and bottom of the cam ring diametrically opposite to one another. The direction of rotor rotation is clockwise as indicated by arrow 45 in FIG. 1. The inlet ports or windows 46 and 48 are shown in dashed and solid lines and are diametrically opposite to one another, on the left side and right side respectively of cam ring 34.

In a conventional balanced vane pump, each vane is pressed outwardly against the inner surface 32 of the cam ring 34 by centrifugal force, and slides in and out within its own radially-aligned slot in rotor 20, as it spins around the cam ring. Hydraulic assist is provided via high pressure hydraulic fluid ported to undervane holes 51-60 in the rotor, which are respectively associated with vanes 21-30, and are part of the undervane poring system, to help ensure that the vanes faithfully track the inner surface 32 of the cam ring 34.

FIG. 2 is a hydraulic diagram showing the fluid circuit coupling the two sets of diametrically-opposed ports or windows. Outlet ports 42 and 44 are respectively connected by conduits 62 and 64 to a common high pressure gallery 65. Inlet ports 46 and 48 are connected by conduits 66 and 68 to a common low pressure gallery 69. High pressure hydraulic fluid discharged from ports 42 and 44 flows as indicated by broad arrows 72 and 74 into one stream of fluid indicated by arrow 75 to a pressure relief and flow control valve (not shown in FIGS. 1 or 2) which is normally built into the pump housing. Low pressure fluid discharged from the relief valve or obtained from a hydraulic reservoir which is indicated by arrow 79, is divided into two flows indicated by arrow 76 and 78 and passed to the inlet ports 46 and 48.

The two discharge ports 42 and 44 are 180° apart, as are the two inlet ports 46 and 48. Thus, pressures radially applied against the generally circular outer edge 80 of rotor 20 cancel each other. In this manner, forces on the rotor are largely balanced in a radial direction. Since two sets of ports are used, balanced vane pumps indicated by arrows 82 and 84 have two discharge or pumping quadrants or sectors 82 and 84, which discharge oil into outlet ports 42 and 44 respectively, and have two inlet quadrants or sectors, indicated by arrows 86 and 88, which respectively draw in fluid through inlet ports 46 and 48.

The displacement of a balanced vane pump, that is, its volumetric output per revolution, is fixed and depends on the width of the cam ring (which is the same as the width of the rotor), and the throw of the cam ring. Balanced vane pumps provide large displacements in a relatively small size package, especially since this type of pump can be operated at high speeds. Vane pumps are popular because of their small size, good efficiency, durability, capacity and speed ranges. Balanced vane pumps produce output pulsations that are low in amplitude, with a frequency corresponding to the number of vanes times the revolutions per second of the pump shaft. Conventional vane pumps are fairly quiet, but are known to whine at high speed.

Power steering pumps of the balanced vane type used in the automotive industry and mobile equipment industry typically include a pump cartridge sandwiched between a pressure plate in the cover of the pump housing and a thrust plate in the body of the pump housing. The pump cartridge consists of these two plates, the cam ring, rotor, and vanes. Internal porting is provided in the pump which allows the high pressure hydraulic flow created by the pump as it operates to bear against the pressure plate. The pressure plate in turn bears against the cam ring in order to control clearances as pressure output increases. Specifically, this provides hydraulic squeeze which maintains or even reduces the operating clearance provided between the cam ring, rotor and vanes on the one hand and the thrust plate or pressure plate on the other hand as the hydraulic pressure increases. In this manner, pump efficiency and pressures obtainable are increased since significant leakage from one pumping chamber to the next which otherwise would occur is prevented. However, the use of the pressure and thrust plate concept increases the costs of manufacturing a power steering pump since these parts must be machined and assembled.

For the last fifteen years or so within the automobile industry, there has been an intense desire to reduce weight and manufacturing costs while maintaining or improving upon car performance. It is the primary object of the present invention to provide a simplified balanced vane power steering pump which satisfies these goals. In particular, primary objectives of the present invention include the following:

(1) to reduce the weight of the power steering pump by making the pump from fewer parts, and by making sections of the housing from lightweight metal casings or other lightweight materials;

(2) to reduce manufacturing costs of the power steering pump by eliminating some of the machining operations required to make the housing and cover of a conventional power steering pump; and (3) to reduce the noise levels produced by the power steering pump, particularly at high speeds where conventional pumps are known to whine, by using a radially and axially balanced low pressure and high pressure porting systems.

Related objectives of the present invention include eliminating the use of separate pressure and wear (thrust) plates in power steering pumps and reducing the pump's weight by using an all-aluminum housing made in three separately cast sections.

Still other objectives of the present invention are to provide a power steering pump with reduced cavitation at high speeds by reducing turbulence through the use of contoured and generally symmetrical galleries and passages to deliver low-pressure hydraulic fluid to four inlet windows.

SUMMARY OF THE INVENTION

In light of the foregoing problems and in order to fulfill the foregoing objectives, there is provided an improved balanced vane power steering pump as described in detail below and depicted in FIGS. 3 through 14. In accordance with a first aspect of the present invention, this improved vane hydraulic pump has four low pressure inlet windows and four high pressure discharge windows. The improved pump is of the type that has a cam ring having a generally elliptical machined inner surface and supported in place within the pump housing; a rotor centrally located within the cam ring and mechanically driven by a pump shaft; and a plurality of vanes located in slots within the rotor. The pump includes: a pump housing; regulating valve means located within the pump housing; a pump drive shaft extending at least partially through the pump housing. Most importantly this pump also includes low pressure passage means, located within the pump housing and arranged in a substantially balanced plurality of interconnected concourses, for forming and substantially evenly delivering low pressure hydraulic fluid to first and second pairs of inlet windows, with each such pair of inlet windows being located adjacent to a respective one of the low pressure sectors of the pump. The pump also includes high pressure passage means arranged in a plurality of interconnected concourses for forming and receiving high pressure hydraulic fluid discharging from first and second pairs of outlet windows, with each such pair of outlet windows being located adjacent to a respective one of the high pressure sectors of the pump. The interconnected concourses of the low pressure passage means preferably form wishbone-shaped gallery located adjacent a pardon of the outer surface of the cam ring within the pump housing. The wishbone gallery is configured to evenly divide the main stream of low pressure hydraulic fluid into two smaller streams, each delivering fluid to one pair of inlet windows.

According to a second aspect of the power steering pump of the present invention, there is provided a balanced vane hydraulic pump which includes a pump housing made from plurality of discrete housing sections, and which includes a cam ring, rotor and vanes as previously described. The first housing section is a casting provided with an integrally formed substantially planar wear surface which serves as a thrust or wear plate. The second housing section is a casting provided with an integrally-formed pressure plate having a substantially planar wear surface.

When the pump housing is formed in three sections, namely, a front housing section, a center housing section and a rear housing section, the aforementioned planar wear surfaces are provided in the front and rear housing sections, and the cam ring is located within the center section housing. The integrally formed pressure plate is preferably part of the rear housing and may be formed as a semi-flexible inner wall through the use of thinned regions of the inner wall which can bend slightly in response to hydraulic forces generated by pressurized fluid in a gallery behind the wall. In this manner, the inner wall, functions as a diaphragm responsive to the high pressure output of the pump to help control leakage between the high pressure quadrants of the pump and adjacent low pressure regions of the pump. The pump also preferably includes the same low pressure passage means within the pump housing for delivering low pressure hydraulic fluid to low pressure sectors of the pump located adjacent the cam ring on opposite sides of the drive shaft, and high pressure passage means within the pump housing, for delivering high pressure hydraulic fluid discharging from two high pressure sectors of the pump adjacent the cam ring and located on opposite sides of the drive shaft.

According to a third aspect of the present invention, there is provided a balanced vane hydraulic pump comprising a pump housing formed from three separate lightweight castings, including a front housing section, center housing section and a rear housing section which need not include separate thrust or wear plates. The pump is also comprised of means for removably joining the three housing sections together as a one-piece housing, which means preferably draw the front and rear housing sections together with a predetermined amount of force, with the center housing section sandwiched in between four or more bolts. The pump also includes a conventional rotor, several vanes slidably arranged within slots of the rotor, and a cam ring, all arranged within the center housing section. The pump further includes the low and high pressure passage means within the pump housing as previously described.

According to this aspect of the present invention, no separate thrust or wear plates, need be included in this pump, not even an integrally-formed semi-flexible pressure plate, if measures are taken to reduce the area over which high pressure hydraulic forces are generated, that tend to increase operating clearances.

These and other advantages, objects and aspects of the present invention may be further understood by referring to the detailed description, accompanying Figures, and appended claims.

BRIEF DESCRIPTION OF THE DRAWINGS

The drawings form an integral part of the description of the preferred embodiments and are to be read in conjunction therewith. Like reference numerals designate the same or similar components or features in the various Figures, where:

FIG. 1 is a conventional mechanical diagram to illustrate the principles of operation of a balanced vane pump;

FIG. 2 is a conventional hydraulic diagram to help illustrate the principles of operation of a balanced vane pump;

FIG. 3 is a simplified cross-sectional view of the inside of a balanced vane pump of the present invention illustrating the balanced flow of low pressure fluid around the cam ring to inlet sectors located on opposite sides of the cam ring;

FIG. 4 is a simplified cross-sectional view of the FIG. 3 diagram taken along line 4—4 of FIG. 3 illustrating the balanced flow of low pressure fluid into a pair of inlet windows located in the same low pressure sector of the pump;

DETAILED DESCRIPTION OF THE PREFERRED EMBODIMENTS

Figure 5:
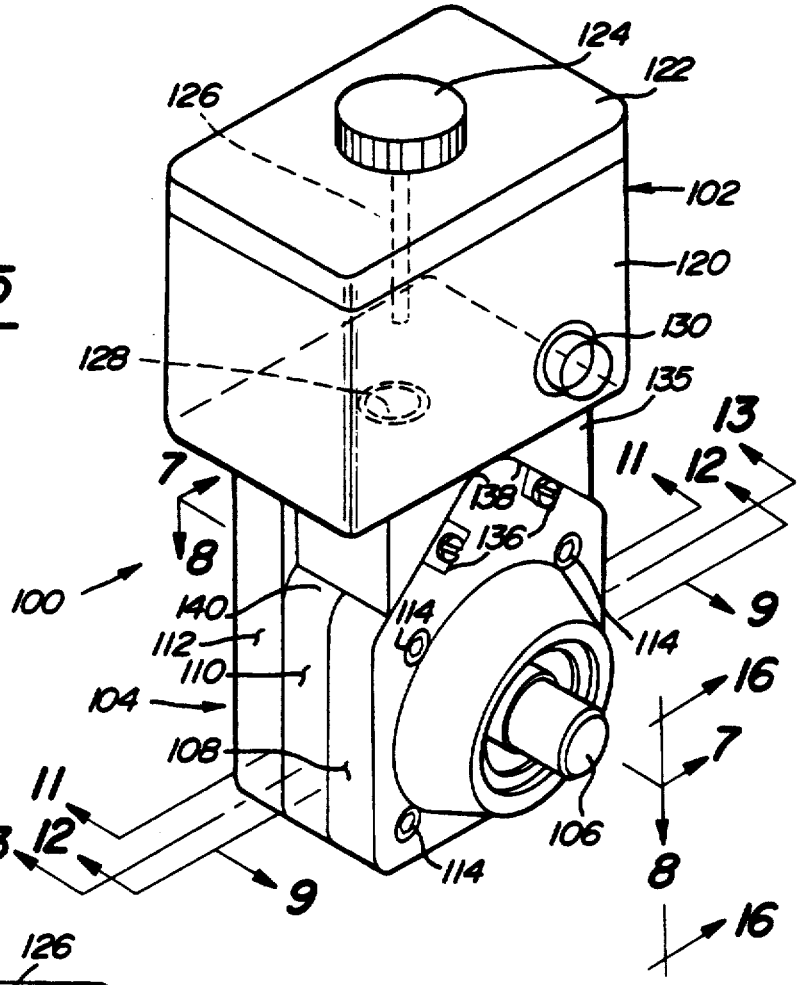
FIG. 5 is a perspective view of an assembled power steering pump of the present invention showing a hydraulic reservoir on top of the pump housing, which is formed of front, center and rear housing sections, with the drive shaft of the pump projecting out from the front housing section.

FIGS. 3 through 15 illustrate preferred embodiments of the present invention, and are exemplary of but not the only ways in which the novel balanced vane pump of the present invention may be implemented.

FIGS. 3 and 4 illustrate face and side cross-sectional views of the cam ring and rotor of the present invention with broad arrows which diagrammatically show the balanced flow path to the four inlet windows that provide hydraulic fluid to the two low-pressure quadrants of the pump. For simplicity's sake, the vanes are not shown in FIG. 3. In FIG. 3, the incoming stream 79 of low-pressure hydraulic fluid is shown dividing into two streams 76 and 78 on left and right sides respectively of cam ring 34 to enter low-pressure sectors 46 and 48. The mechanism by which the flow is so divided is a gallery 85 shown in phantom and having a wishbone shape, which is located primarily in the center section of the pump housing, which will be described shortly. This wishbone gallery 85 has two bone-like or elongated side concourses 86 and 88 connected to a main concourse 89. The side concourses 86 and 88 respectively neck down at locations 90 and 92 and then widen again at lower portions 96 and 98 respectively. As shown in FIG. 4, the stream 76 flowing into the left concourse 86 of wishbone gallery 85 is further evenly divided into front and rear streams 76F and 76R which respectively enter front and rear inlet windows 46F and 46R of the low-pressure inlet sector 46 of the pump. The wishbone gallery 85 preferably has a smooth, contoured design as shown which helps reduce flow discontinuities and abrupt changes in fluid velocity as the fluid courses through passages 86 and 88. It may also help reduce operating noise of the pump. Further dividing each of the left and right streams 76 and 78 into front and rear streams (like streams 76F and 76R) so that low-pressure fluid is supplied evenly to the front and rear sides of the cam ring is also believed to be an innovation. It is believed to help balance axial as well as radial hydraulic forces on the rotor 20. This wishbone gallery design provides a balanced flow inlet system within a three-piece housing configuration in a minimum package size with good high speed capabilities. How these innovations may be implemented in balanced vane pumps will be made clear below.

Figure 6:
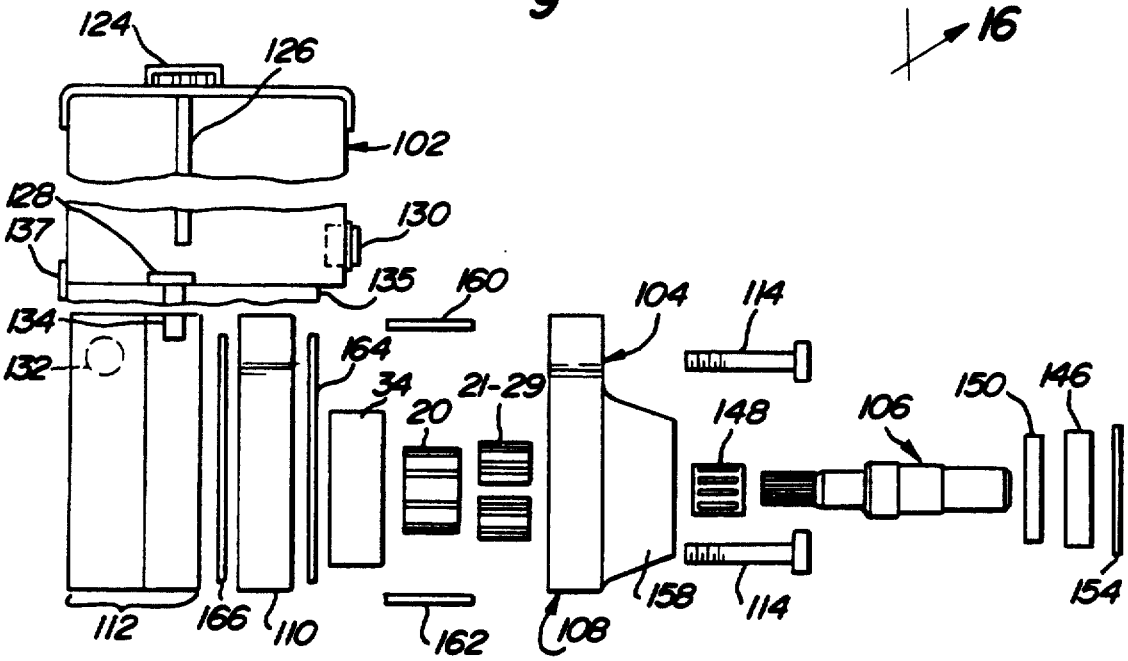
FIG. 6 is a simplified exploded view of the FIG. 5 pump showing various components of the pump.
Figure 7:
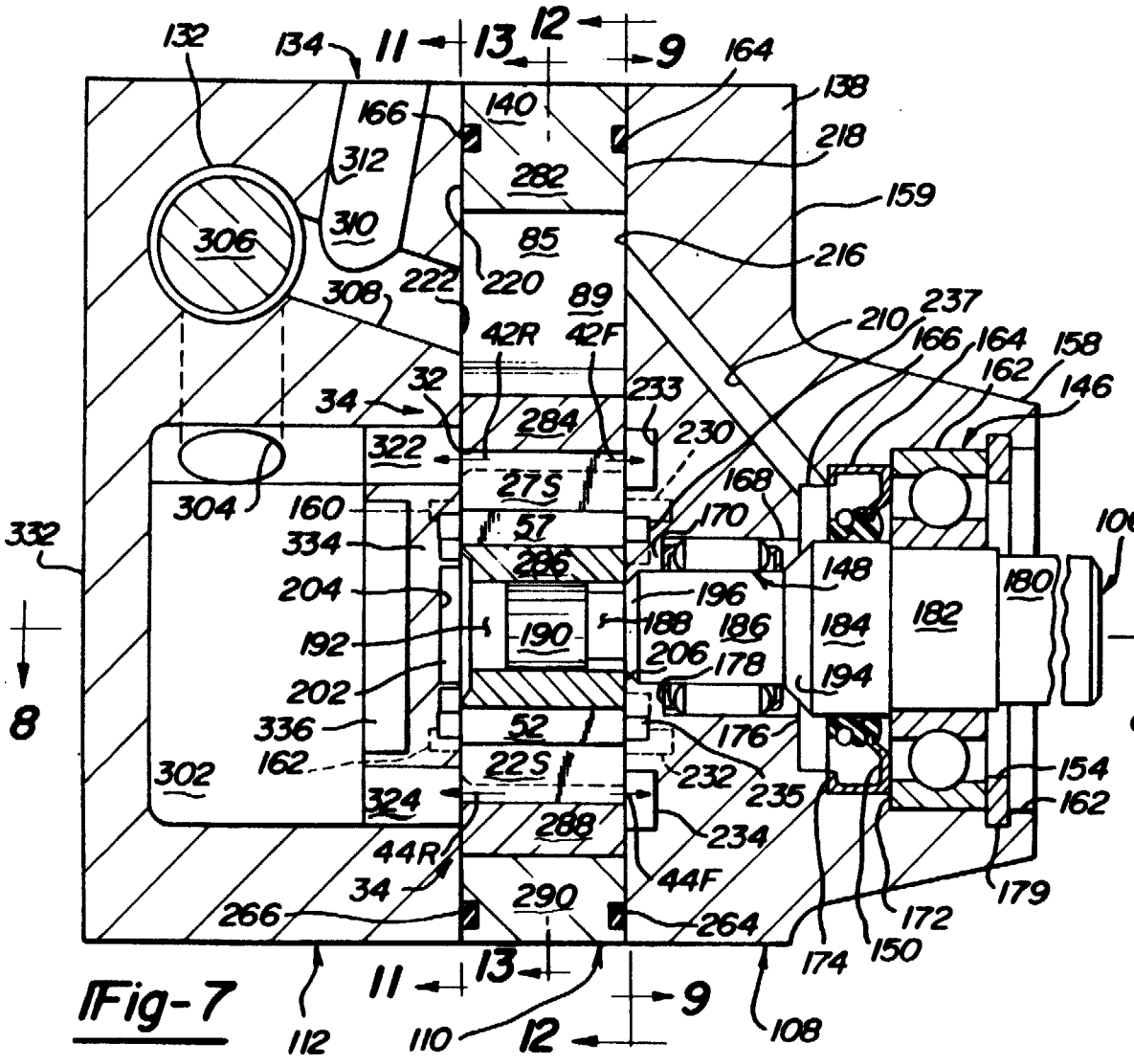
FIG. 7 is a vertical cross-section of the FIG. 5 pump taken along line 7—7, and showing some of the hydraulic passages, galleries and components in the pump housing, including a flow regulating valve in the rear housing section, the rotor and vanes in the center section, and the two sets of bearings in the front section.

FIG. 5 shows a perspective view of an assembled balance vane hydraulic pump 100 of the present invention. Pump 100 includes reservoir assembly 102 attached to a pump housing 104 which has a pump drive shaft 106 extending therefrom. The pump housing 104 is preferably formed in three separately cast sections, namely, front housing section 108, center housing section 110 and rear housing section 112. Housing sections 108 and 112 are held together, with center housing section 110 sandwiched in between, by fastening means 114, such as steel hex nut head bolts, SAE grade 5 or better. The reservoir 102 includes a base section 120 which is preferably formed of a translucent plastic material, and a cover 122 provided with a filler/breather cap 124. The cover 122 is preferably permanently attached to the base 120. A dip stick 126 may be connected to the cap 124 for readily measuring the level of the hydraulic fluid. A leak-proof coupling 128 is provided in the bottom of base 120 to allow fluid from the reservoir into opening 134 of the pump housing 104. A return line coupling 130 may be provided at any convenient location on the base 120 for receiving a low-pressure return line hose. Not shown in FIG. 5, but shown in FIGS. 6 and 7 is an opening 132 for the high-pressure discharge line for the pump. Any suitable coupling member may be press-fit, threaded or otherwise seated in opening 132 for permitting a hose or other type of hydraulic line to be connected thereto. The reservoir 102 also may include additional base support section 135 which wraps about the triangularly-shaped tops 138 and 140 of the front and center housing sections 108 and 110. Flat tabs 136 and 137 integrally molded into the base 120 of the reservoir may be provided for securing the reservoir 102 to the pump housing 104 by screws or rivets passing through the tabs into the housing.

FIG. 6, an exploded side view of pump 100, shows various components internal to the pump 100. Pump shaft 106 is supported entirely by the front housing 108 via ball bearing assembly 146 and roller or needle bearing assembly 148. A shaft seal 150, preferably of the lip seal type, is provided to prevent leakage of hydraulic fluid past the largest diameter of the shaft 106. A retaining ring 154 is used to hold the ball bearing assembly 146 in place within the truncated conical portion 158 of the front housing section 108. FIG. 6 also shows rotor 20, vanes 21 30 and cam ring 34. As in conventional power steeling pumps, two steel locator pins 160 and 162 are provided to hold the cam ring 34 in place in the pump housing 104. Front and rear gasket means 164 and 166 are provided to seal the center housing 110 with respect to the front and rear housing sections 108 and 112.

FIG. 7 is an enlarged cross-sectional view of the pump 100 taken along lines 7—7 of FIG. 5, which shows details of the internal construction of the pump. Further features of the front, center and rear housing sections will now be described.

The front housing section 108 includes a generally trapezoidal rear portion 159 and the truncated conical portion 158 extending therefrom. Internally, the front section 108 has machined into it five diameters 162,164,166,168 and 170 with each being smaller than the preceding diameter so as to form stop shoulders 172, 174, 176 and 178. Additionally, a rectangular groove 179 is machined into diameter 162 for capturing the retaining ring 154. The pump shaft 106 has several different diameters 180, 182, 184, 186, 188 and 1 90, and also has tapered conical areas 194 and 196 to permit the flow of hydraulic oil past these tapered regions. The diameter 190 is splined and engages corresponding a splined socket area of the rotor 20. The region 192 is empty, since the pump shaft 106 has no need to extend beyond splined diameter 190 because the pump shaft 106 is supported only by the bearing assemblies 146 and 148 in the front housing section 108. A pulley or other drive coupling member may be mounted to diameter 180 of pump shaft 106. Only a portion of the splines of rotor 20 need be engaged by the pump shaft 106. In a preferred embodiment, a centrally located region is engaged which permits mechanically balanced driving of rotor 20 without the pump shaft 106 restraining movement of rotor 20 in an axial direction.

The ball bearing race assembly 146 is located between diameters 162 and 182 of the front housing section and pump shaft. A conventional lip seal 150 provides a barrier for low-pressure hydraulic fluid by stationarily sealing housing diameter 164 while providing a rotating seal against diameter 184 of the pump shaft. The roller bearing assembly 148 is positioned between diameter 168 of the housing and diameter 186 of the pump shaft and is restrained against axial movement by stop shoulder 170 of the housing and by tapered surface 194 of the pump shaft 106. Lubrication to the roller bearing assembly 148 is provided by hydraulic fluid which leaks to low-pressure regions or pockets 202, 204 and 206 adjacent the splined area of rotor 20 from the high-pressure quadrants of the pump. This hydraulic fluid is drained past roller bearing assembly 148 to the annular volume whose outer periphery is defined by diameter 166 and stop shoulder 176 of the front housing 108, and by the lip seal 150. This annular volume is drained by diagonal drain line 210 which connects to the wishbone gallery 85 of center housing section 110 as shown.

Figure 9:
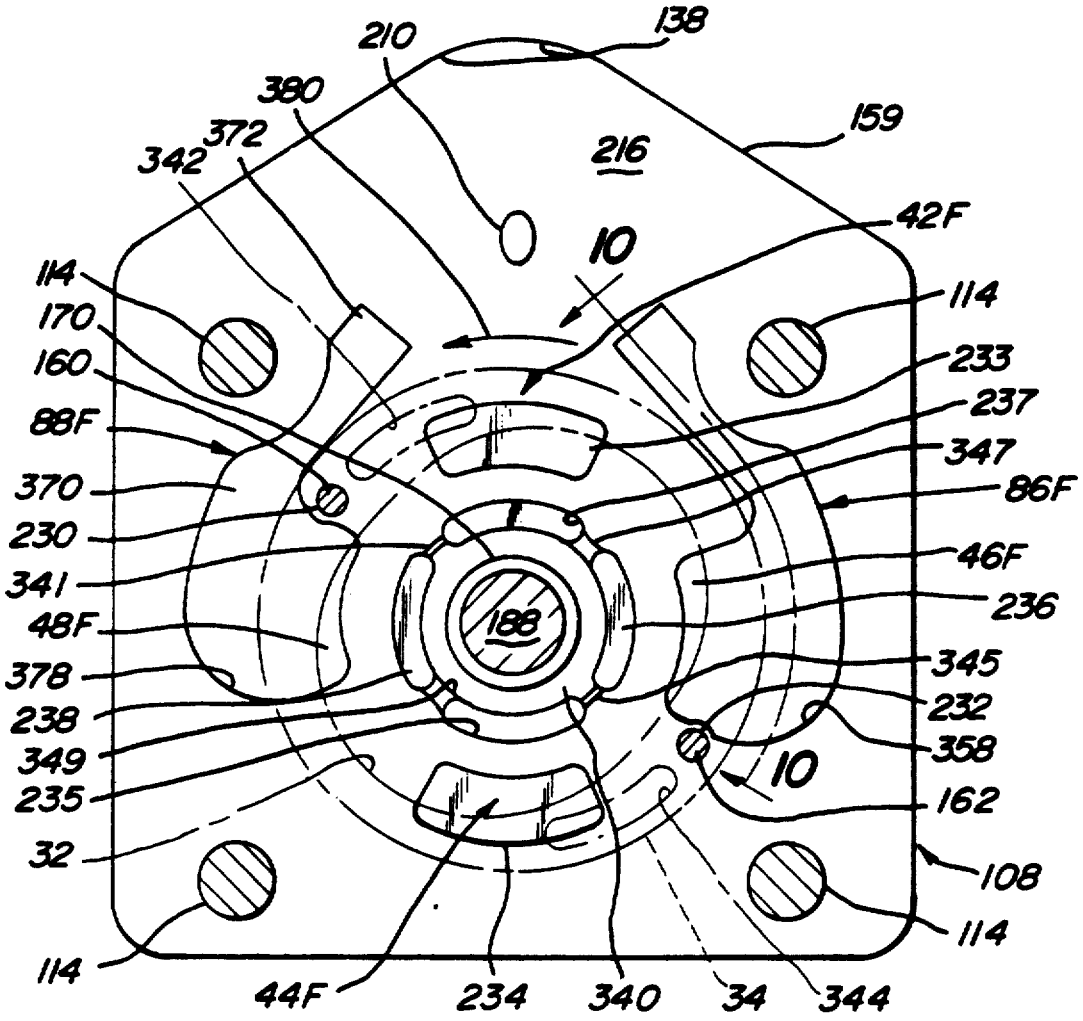
FIG. 9 is a cross-sectional view of the FIG. 5 pump taken along the line 9—9 of FIGS. 5 and 7 showing the high and low pressure passages provided in the inside face of the front housing section.
Figure 11:
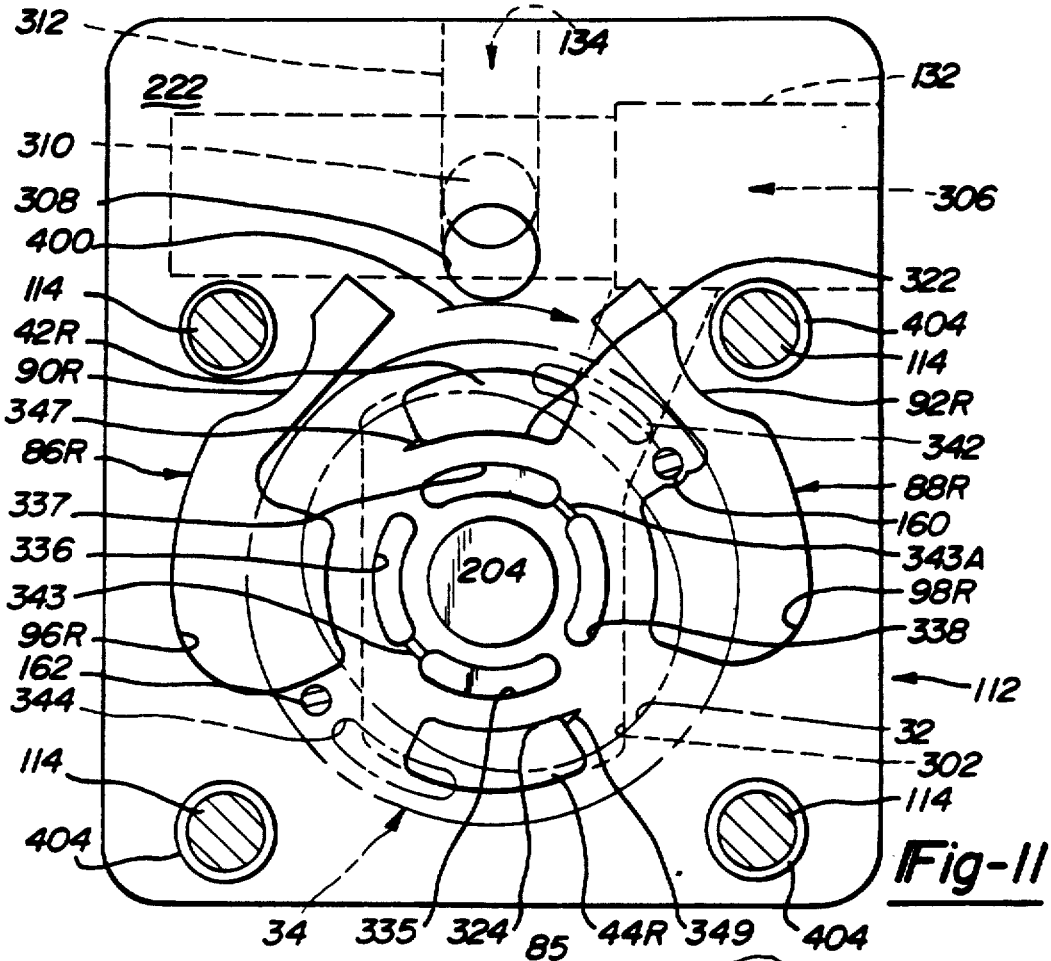
FIG. 11 is a cross-sectional view of the FIG. 5 pump taken along lines 11—11 of the FIGS. 5 and 7 illustrating the locations of the high pressure and low pressure passages provided in the inside face of the rear housing section.
Figure 12:
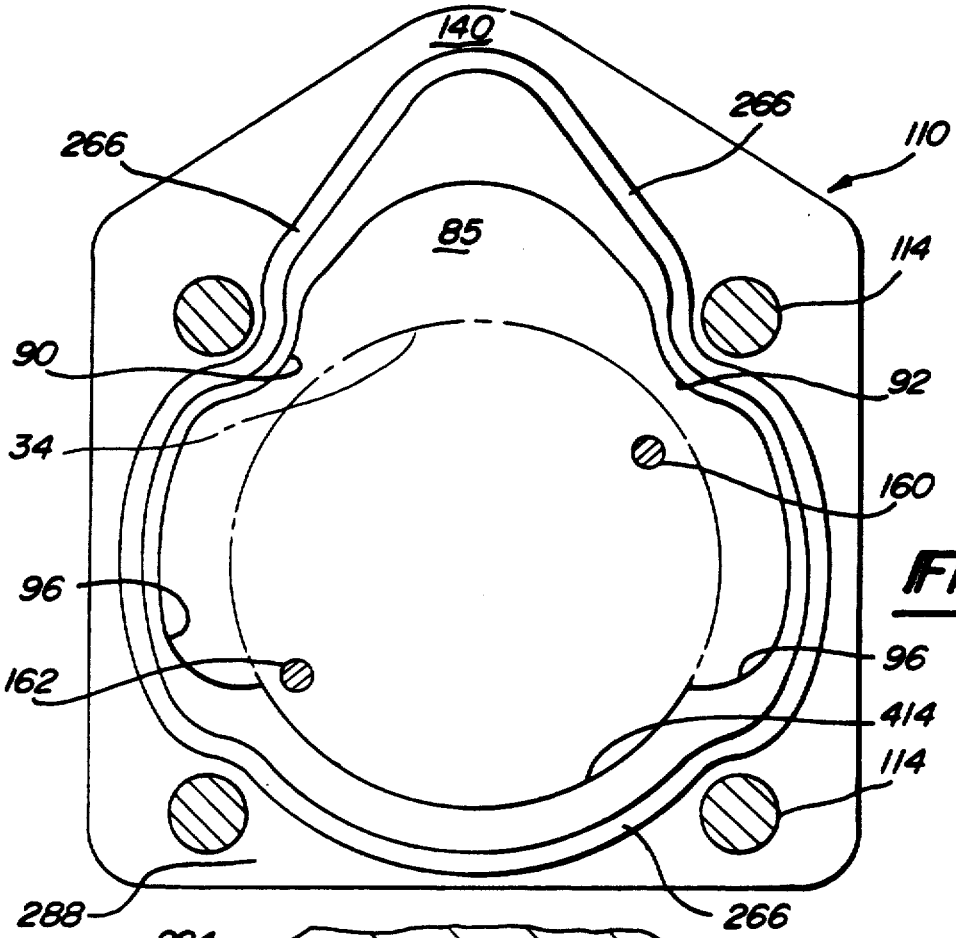
FIG. 12 is a cross-sectional view of the FIG. 5 pump taken along line 12—12 of FIG. 5 showing a front face of the center housing section, and its O-ring groove and the location of the wishbone gallery arranged about the top and sides of the cam ring shown in phantom.

The front housing section 108 has a substantially planar inner face or surface 216 shown in FIG. 9 which abuts up against a corresponding substantially planar face 218 of center housing section 110, which is best shown in FIG. 12. Similarly, the substantially planar face 220 on the opposite side of center section 110, which is identical to face 218, abuts against substantially planar inner face 222 of rear housing section 112, which is best shown in FIG. 11.

Figure 8:
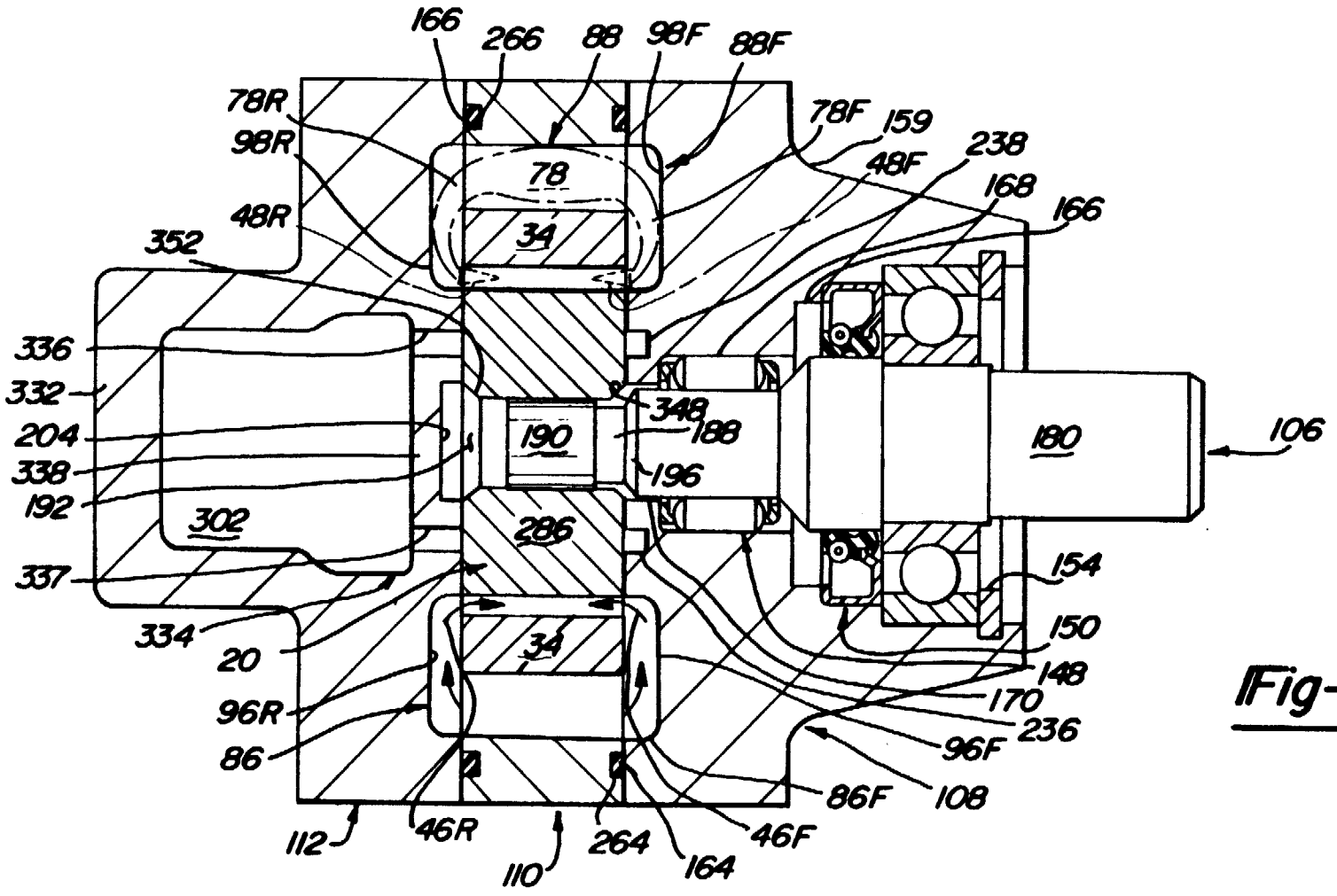
FIG. 8 is a horizontal cross-sectional view of the FIG. 5 pump taken along line 8—8 of FIGS. 5 and 7.

As can be understood by studying FIGS. 7, 8 and 9, the face 216 of front housing section 108 has formed in it ten blind openings, including: holes 230 and 232 for the cam ring locator pins 160 and 162; oblong openings 233 and 234 which permit hydraulic fluid to be discharged from windows 42F and 44F; sausage-shaped openings 235 through 238 which are part of the undervane porting system which will be further described; and elongated openings 86F and 88F which are the front parts of the concourses 86 and 88 of wishbone gallery 85 illustrated in FIG. 3.

In FIG. 7, center housing section 110 is shown as having continuous grooves 264 and 266 formed in the flat faces 218 and 220 respectively. These grooves are for O-ring seals 164 and 166. The shape of grooves 264 and 266 are preferably substantially identical and may take a form as shown in FIG. 12 for groove 266.

In FIG. 7, in the center housing section of pump 100, there is shown, from top to bottom, the following: the top portion 140 of center housing section 110, the main concourse 89 of wishbone gallery 85, top portion 284 of cam ring 34, the slot 27S in rotor 20 for vane 27 and its associated undervane hole 57, annular splined region 286 of the rotor 20, undervane hole 52 and the associated lot 22S for vane 22, bottom portion 288 of the cam ring 20, and bottom portion 290 of the housing 110.

The rear housing section 112 shown in FIG. 7 includes an internal high pressure chamber 302 which is connected by a cylindrical passage 304 to chamber 132, which has a conventional flow control and relief valve 306 located therein, such as the valve used in the automotive power steering pumps made by the Saginaw Division of General Motors Corporation. The internal chamber 302 is connected by upper and lower high pressure passages 322 and 324 which form high-discharge windows 42R and 44R. The overall configuration of chamber 302 may be understood by studying FIGS. 7, 8 and 11. The rear housing section 112 also includes a bypass passageway 308 connected at location 310 to passage 312 leading to opening 134 which is the inlet port for reservoir 102.

As may be seen in FIGS. 7 and 8, rear housing section 112 has an external wall portion 332 and an internal wall partion 334 which is preferably thinned in its center region about the axis of the pump shaft 106 by a pocket chamber 336 which is preferably cylindrical and directly connected to chamber 302. This leaves a center region 338 of wall portion 334 as a thin wall section which can respond to hydraulic pressure within the chamber 302, thereby maintaining or reducing cam ring and vane clearances with the portion of the wall facing the rotor 20 and vanes 21-30. In this manner, the wall section 338, although an integral part of casting forming the rear housing section 112, can nevertheless serve as a semi-flexible pressure plate to maintain desired operating clearances at higher pressures. The thickness of the wall section 338 will depend on many factors, including the diameter of chamber 336 in comparison to the diameter of rotor 20 and precise shape of inner surface 32 of cam ring 34, the desired operating clearances between rotor 20 and faces 216 and 222 and the like. In the FIG. 7 embodiment of the present invention, desired operating clearances between the rotor and vanes on the one hand and each of the inner side surfaces 216 and 222 of the front and rear housing sections 108 and 112 on the other hand are preferably about 0.0005 inch to about 0.001 inch.

FIG. 9 is a vertical view of the FIG. 5 pump taken along line 9—9 of FIGS. 5 and 7. This view shows the inside face 216 of the front housing section 108, particularly the relationships between the various blind openings and the cam ring 34, which is shown in phantom superimposed upon the face 216. Readily identifiable components shown in this view include the four bolts 114 and the cam ring locator pins 160 and 162 which are slidably received into blind holes 230 and 232 in the face 216 of housing section 108. Also, the diameter 188 of the pump shaft is shown centered within diameter 170 within face 216.

Openings 235–238 of the undervane poring system are also visible, concentrically arranged about the diameter 170 and separated therefrom by a generally annular flat surface portion 340 of face 216. The porting to blind openings 235 and 236 is conventionally provided through the rotating undervane holes 51 through 60 within the rotor 20. Similarly, the poring to blind openings 233 and 234 is conventionally provided through oblong, sausage-like thru-holes 342 and 344 shown in phantom in the cam ring 34 in FIG. 9. The porting to low pressure inlet windows 46F and 48F is provided by blind openings 86F and 88F which form part of the wishbone gallery, as previously described.

Figure 10:
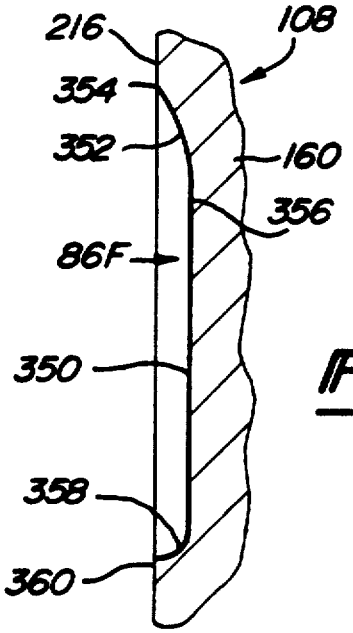
FIG. 10 is a partial cross-sectional view of the front housing section taken along line 10—10 of FIG. 9 showing the sloped and contoured low pressure inlet passageway region.
Figure 10A:
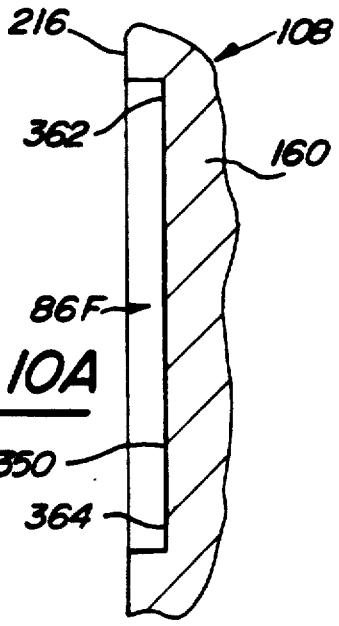
FIG. 10A is a partial cross-section view of the front housing section taken along line 10—10 of FIG. 9 showing an alterative construction for a low pressure inlet passageway.

FIG. 10 and FIG. 10A shown two alternate arrangements for the opening 86F shown in FIG. 9. Most of the bottom surface 350 in each of the openings 86F and 86F' is flat and coplanar with respect to face 216. However, as shown in FIG. 10, the upper bottom surface 352 slopes from point 354 downward to area 356 in order to provide a gentle ramp so as to not introduce abrupt changes in the size of the opening 86F, which tend to introduce some turbulence in the fluid flow. Similarly, the bottom portion 358 of opening 86F describes a gentle arc, such as a quarter circle, to point 360 on the face 216 of housing section 108. In contrast, opening 86F' shown in FIG. 10A does not provide gentle tapers at the top and bottom portions of the opening. Instead, abrupt upper and lower corners 362 and 364 are provided. These two abrupt corners will work, but are believed to possibly introduce fluid flow discontinuities and detract from efficient rapid flow of fluid through the opening 86F to the low-pressure inlet window 46F. The other opening BBF may be made generally as a mirror image of opening 86F, for balanced resistance to fluid flow.

Also, as may be seen in FIG. 9, the length of opening 86F is preferably made slightly greater than the length of opening 88F. This difference in length is deliberate and allows the fluid eventually provided to inlet window 46F slightly more space to slow down and turn around to match the direction of movement of the vanes 21–30 rotating with rotor 20. The broad arrow 380 near the top of FIG. 9 shows the direction of rotation of the rotor 20 with respect to the face 216. As such, it can be seen that the hydraulic fluid flowing downwardly through concourse 86F must change direction and flow upwardly with the vanes, whereas the hydraulic fluid through concourse 88F is carried in the same general downward direction as the rotating vanes. By lengthening and enlarging concourse 86F slightly with respect to concourse 88F, h is believed that more balanced hydraulic operation may be obtained, by substantially neutralizing the effect of the hydraulic fluid in concourse 86F changing direction. In other words, it is believed that better balancing of the hydraulic forces experienced by the rotor 20 and vanes 21–30 is likely achieved in this manner.

FIG. 11 is a view of the face 222 of the rear housing section 112. The direction of rotation of the rotor and vanes with respect to this face is indicated by broad arrow 400. The location of the cam ring 34 in relation to the various openings and passages in the rear housing section 112 is shown by illustrating the cam ring 34 in phantom. The blind openings in rear housing section 112 are often mirror images of corresponding blind openings found in the face 216 of front housing section 108 shown in FIG. 9. For example, circular blind openings are provided for locator pins 160 and 162. In addition, openings are provided for the four bolts 114. The threaded end of the bolts 114 are screwed into corresponding threaded openings found in the rear housing section 112. In practice, it may be preferable to tighten the bolts past the yield strength of threads tapped into certain lightweight material out of which the rear housing section 112 may be made, such as aluminum. In such instances, it is preferred to use conventional steel threaded inserts 404 for greater bolt-holding strength.

Also shown in FIG. 11 are the undervane openings 335 through 338 which also provide fluid to the undervane holes 51–60 in the rotor 20. The undervane openings 336 and 338 are thru-holes and interconnect to high-pressure fluid chamber 302 of the rear housing section 112, which is shown in dashed lines in FIG. 11. The top and bottom undervane holes 337 and 335 are blind holes, in that they do not pass directly through to chamber 302. Instead, opening 337 is connected by control orifice or groove 342 to opening 338. Blind opening 335 is connected by control orifice or groove 343 to opening 336. In FIG. 9, similar narrow control grooves 341 and 345 are shown between undervane openings 237 and 238 and between undervane openings 235 and 236, respectively. Further, in FIG. 9 large, shallow control grooves 347 and 349 are shown between undervane openings 236 and 237 and between 235 and 238, respectively. Such control grooves of the type shown in FIGS. 9 and 11 are found on conventional power steering pumps from the Saginaw Division of General Motors. These control grooves help ensure that the vanes in the high-pressure sectors of the pump track properly with reduced noise. Also shown in FIG. 11 are lead-in control or metering grooves 346 and 346A, which are also found in conventional balanced vane power steering pumps from General Motors.

FIG. 12 is a view of the face 218 of the center housing section 110. The cylindrical outer perimeter of the cam ring 34 is shown in phantom. The bottom section 288 of the housing includes a generally cylindrical arc 414 which matches the outer diameter cam ring 34 as shown. The shape of wishbone gallery 85 is clearly shown in FIG. 12, including the rounded lower regions 96. These regions 96 are contoured to be a gentle curve, such as a pardon of an ellipse, to help smoothly deliver low-pressure fluid to inlet windows 46F and 46R and 48F and 48R respectively. The necked-down regions 90 and 92 of the gallery also represent gentle contours that help ensure that low into the main course 89 of gallery 85 relatively evenly divide between the two legs or concourses 86 and 88.

Figure 13:
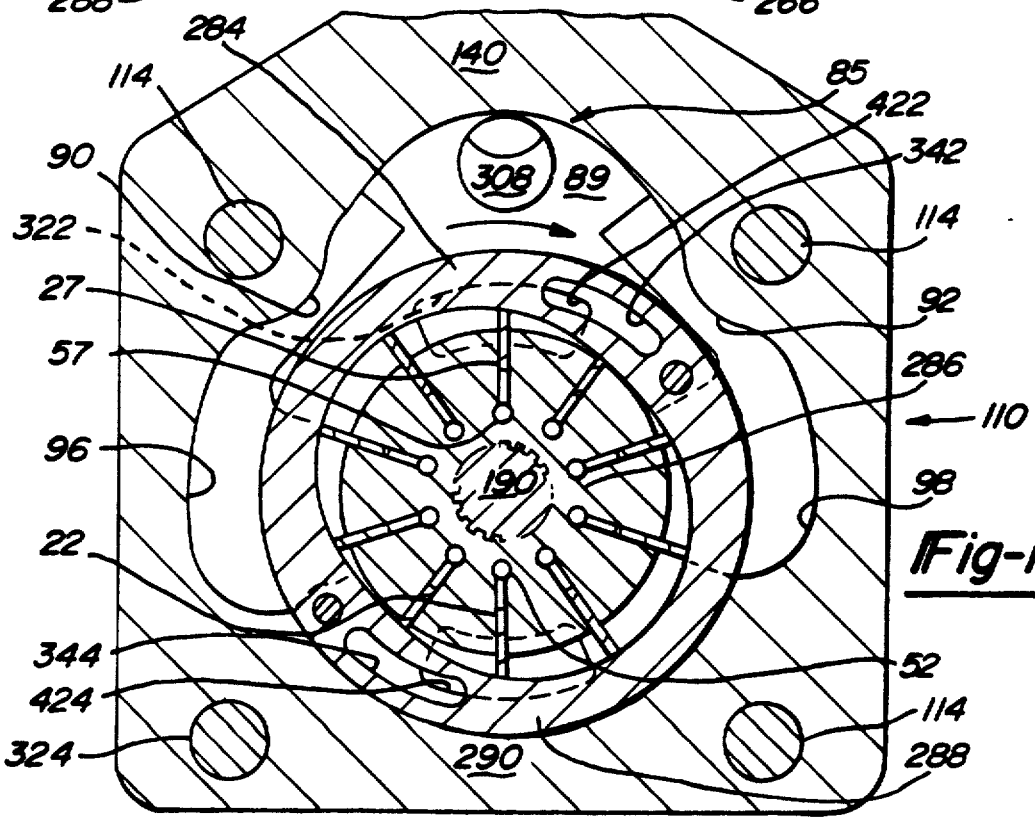
FIG. 13 is a cross-sectional view of the FIG. 5 pump taken along line 13—13 of FIGS. 5 and 7 showing the center housing section, the separate cam ring, rotor and vanes in operative relation with respect to one another and with respect to the high and low pressure passages of the inner face of the rear housing section respectively shown in phantom and in solid.

FIG. 13 is a vertical cross-sectional view through the center housing section 110 taken along lines 13—13 of FIGS. 5 and 7 and showing the positional relationships between the wishbone gallery 85, the rotor 20 and vanes 21-30 and the cam ring 34. It also shows the oblong discharge overpass openings 342 and 344 passing axially through the cam ring 34. As may be seen, there is an overlap area 422 between oblong passages 342 and high-pressure passage 322 in the rear housing section 112. Similarly, there is an overlap area 424 between cam ring passage 344 and high-pressure passage 324 in the rear housing section 112. These overlap areas 422 and 424 may be varied in size, as is illustrated in FIG. 14 to reduce flow restrictions if desired.

The pump 100 just described with respect to FIGS. 3 through 13 may be constructed from any suitable or conventional materials. For example, the front, center and rear housing sections 108-112 may be made of any suitable grade of cast iron, but are preferably made of lightweight metal casting, such as 356-T6 aluminum, or even any suitable high-strength, high-temperature plastic or polymer material. The rotor may be made of any suitable metal, such as 8026 steel, and is preferably heat-treated, such as by carburization, to provide long-wearing surfaces. The vanes may be made or any suitable steel, such as air-hardened A2 or M2 tool steel. The cam ring 34 may be made out of sintered powdered iron using conventional processes. Its inner surface 32 may be precision ground to any desired shape and tolerance used in conventional power steering pumps. The pump 100 can be readily engineered to handle pressures up to about 2000 psi. A typical relief valve setting for automotive power steering applications is about 1200 to 1500 psi, and is readily achieved by pump 100.

Figure 14:
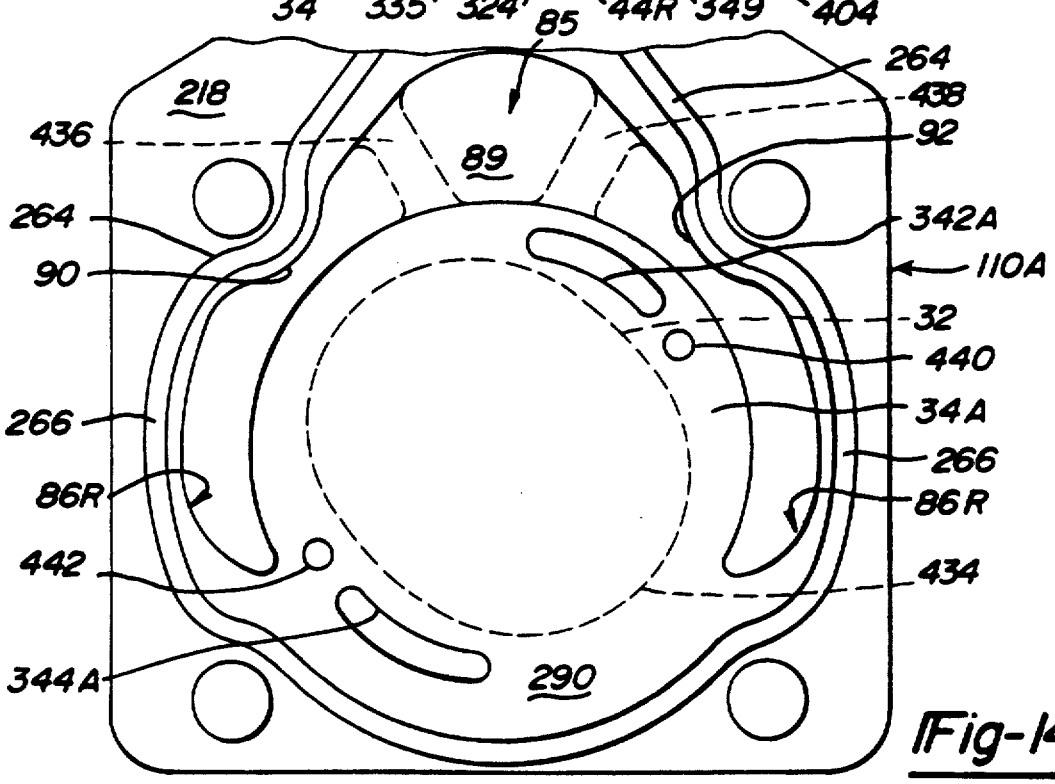
FIG. 14 is a view, from the same perspective as FIG. 12, of the cross-sectional view of the face of an alternative one-piece powdered-metal center housing section having an integral cam ring.

FIG. 14 shows an alternate embodiment 110A for the center housing section 110 and cam ring 34 described above as part of pump 100. Housing section 10A includes an integrally formed pump ring 34A which is made from the same material and at the same time as the rest of the housing section 110A. Housing section 110A is preferably made from any suitable or conventional cast metal material, such as powdered metal. With either material, it is desirable to harden the internal wear surface 32 to some suitable depth such as between about 0.001 inches and 0.010 inches. Such a surface can then be ground using conventional techniques to the required accuracy and shape for inner surface 32. Alternatively, it may be preferable to grind the surface 32 first, and then harden it.

If necessary, the surfaces 218 and 220 on either side of the center housing section 110A may be made finished to any required level of smoothness or flatness by lapping or other techniques. If for any reason additional strength is required in cam ring 34A, integrally-formed webs 436 and 438 (shown in phantom) may be provided as shown in the main concourse 89 of wishbone gallery 85. In general, webs 36 and 38 are preferably a thin oval shape in radial cross-section, so as to restrict only to a minor degree the flow of stream 79 through the main concourse 89 of the wishbone gallery 85.

If desired in cam ring 34A, holes 440 and 442 for locator pins 160 and 162 respectively may be provided. Also, high pressure overpass discharge holes of oblong shape generally corresponding in location and size to holes 342 and 344 in cam ring 34 of FIG. 13 may be provided in cam ring 34A. Alternately, lengthened overpass holes 342A and 344A may be provided to enlarge the overlap areas 322 and 324 described with respect to FIG. 13, if desired.

Figure 15:
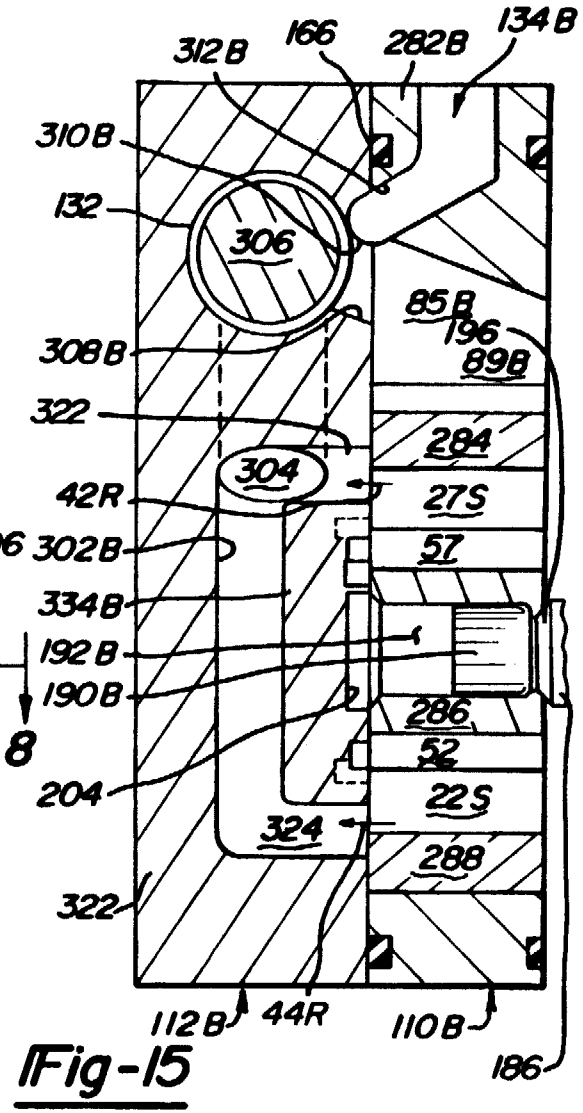
FIG. 15 is a vertical cross-sectional view, similar to FIG. 7, of the center and rear housing sections of the changed portions of an alternative balanced vane hydraulic pump of the present invention, which has shorter pump shaft and smaller rear housing section.

FIG. 15 is a cross-sectional view of yet another alternate embodiment of the hydraulic power steering pump of the present invention. In this embodiment, the center and rear housing sections are altered while the front housing section 108 and the portion of pump shaft 106 within housing section 108 remain unchanged. By way of introduction, note that chamber 302 shown in FIG. 7 is rather large, because the flow control and pressure relief valve is located some distance (about one inch) from the main concourse 89 of wishbone gallery 85. In order to reduce the weight and amount of material required to manufacture the rear housing section 108, the valve 306 may be moved much closer to the wishbone gallery 85. This in turn necessitates changes to the locations of inlet port 334 and connecting line 312 leading to passage 308. Thus, all of these features have been modified as shown in FIG. 15, and the suffix "B" has been appended to the reference numerals to identify each of these and other modified features. To the extent the features or components are unchanged, the same reference numeral found in FIG. 7 has been used. Other features modified in FIG. 15 from the FIG. 7 embodiment are that the wall section 334 in FIG. 7 has been increased in thickness so as to be substantially non-flexible in response to varying hydraulic forces within chamber 302B, and that the splined portion 190 of the pump shaft 106 has been moved to save material. These changes will be now described in further detail.

The movement of valve 306 toward the center housing section results in a very short connecting passage 308B, to deliver relatively high velocity fluid being discharged from the valve 306 to the main gallery 89B. In order to achieve a venturi-like effect to help pull fluid from reservoir inlet port 134B into passage 308B, the connecting passage 312B is angled as shown on a diagonal from the center part of upper section 282B to an area 310B as close as practical to the high-pressure bypass outlet of valve 306. In this manner, a venturi effect which promotes efficient drawing of hydraulic fluid from the reservoir is achieved, as it is in the FIG. 7 arrangement of valve 306 and passageways 308 and 312.

Reduced-size high pressure chamber 302B is interconnected to high pressure connecting passages 322 and 324 and to intermediate passage 304, which delivers discharged high pressure fluid to the inlet of regulating valve 306. The thickness of wall section 334B is increased sufficiently to be non-flexing at expected maximum operating pressures such as 1500 to 2000 psi.

In order to lighten pump shaft 106, the non-splined diameter portion 188 of pump shaft 106 in FIG. 7 has been substantially eliminated. Thus external splined portion 190B engages only about one-half of the internal splined portion 286 of rotor 20. Thus, region 192B is empty of material, and fills with low-pressure hydraulic fluid.

The foregoing detailed description shows that the preferred embodiments of the present invention are well suited to fulfill the objects above-stated. It is recognized that those skilled in the art may make various modifications or additions to the preferred embodiments chosen to illustrate the present invention without departing from the spirit and proper scope of the invention. For example, the mounting arrangement for the reservoir on the pump housing may be changed. The reservoir may located alongside or even connected by hose or other fluid conduit to the pump housing. Also, while it is preferred to have the wishbone gallery located as shown in FIG. 5 with its main concourse located above the cam ring, those in the art will appreciate that the pump orientation may be changed, so the wishbone gallery has a different orientation. The pump may even be operated sideways or upside down from the position shown, as long as pump is kept filled with fluid, since the low pressure side and passageways of the pump are effectively charged to a slight positive pressure by the inrushing fluid dumped through the discharge port of the flow regulating valve.

The precise external shape or configuration of the pump housing is not considered important, but a configuration which helps minimize the weight of the pump housing is preferred. Of far greater importance to pump operation and longevity is providing relatively smooth and open concourses for the fluid to flow through as it courses through the pump. It is believed that by keeping abrupt changes in fluid direction or passage size to a minimum, energy loss in the form of unnecessary turbulence, can be minimized. It is also believed that a well-balanced set of low pressure passageways, exemplified by those passageways of the present invention shown in FIGS. 7 through 14, helps achieve operating noise reductions.

The location and type of the fasteners holding the three-piece pump housing together may also be varied. While a pump drive shaft supported at one end only is shown, those in the art will appreciate that the pump shaft may be lengthened, and another bearing may be provided in the rear housing section if desired, or one bearing provided in the front housing section and one provided in the rear housing section. For example, a bearing could be located in the outside wall of the rear housing section by having the shaft pass through the semi-flexible inner wall of the rear housing section. Alternatively, the bearing could be located directly in or supported by the inner wall, especially if the inner wall was rigid rather than semi-flexible. If necessary a floating bearing design which allows slight movement of the shaft or bearing in an axial direction could be employed. Note that employing a rear bearing would not necessarily require a bearing or shaft seal, since the bearing could be completely enclosed within the rear housing and lubricated by the hydraulic fluid in a manner similar to needle bearing assembly 148.

Still other variations to the preferred embodiments to the present invention are possible. Accordingly, it is to be understood that the protection sought and to be afforded hereby should be deemed to extend to the subject matter defined by the appended claims, including all fair equivalents thereof.

We claim:

1. A balanced vane hydraulic pump having a high pressure outlet discharge port and low pressure inlet return port for use in a power steering system, comprising:

a pump housing;

regulating valve means, located within the pump housing, for regulating flow of high pressure hydraulic fluid from the pump assembly to the high pressure outlet port and for diverting any excess flow back to a low pressure passage in fluid communication with the inlet port;

a pump drive shaft extending at least partially through at least the pump housing;

a cam ring supported in place within the pump housing and having a symmetrical precision-machined inner surface of generally oval configuration upon which outer ends of vanes ride;

a rotor, centrally located within the oval of the cam ring and mechanically driven by the drive shaft, having a plurality of substantially radially arranged slots in which vanes may reciprocate while rotating with the rotor;

a plurality of vanes, each vane being slidably arranged in a respective one of the slots of the rotor so as to be able to bear against the inner surface of the cam ring during operation of the pump assembly;

low pressure passage means, located within the pump housing, in fluid communication with the low pressure inlet port, and arranged in a substantially balanced plurality of interconnected concourses and inlet window regions, for substantially evenly delivering low pressure hydraulic fluid to four inlet window locations adjacent to two low pressure sectors of the cam ring located on opposite sides of the drive shaft, said low pressure passage means including a wishbone-shaped gallery located within a central portion of the housing outside of the cam ring, said wishbone-shaped gallery including smooth gently contoured passageways for delivery of low pressure fluid to said inlet window regions; and high pressure passage means, arranged as four discharge window regions interconnected by elongated concourses, for delivering high pressure hydraulic fluid, discharging from four outlet window locations in two high pressure sectors of the cam ring located on opposite sides of the drive shaft, to the regulating valve means.

2. A pump assembly as in claim 1 wherein:

the regulating valve means includes a discharge port, and the wishbone gallery includes a main concourse in direct fluid communication with the discharge port of the regulating valve means, two elongated concourses directly connected to and in broad fluid communication with the main concourse and diverging from one another toward a respective one of the low pressure sectors of the cam ring.

3. A pump as in claim 2, wherein the portion of each elongated concourses of the wishbone gallery downstream from the main concourse diverge in longitudinal cross-section in order to deliver low pressure hydraulic fluid to a pair of inlet window locations on opposite sides of the cam ring.

4. A balanced vane hydraulic pump for use in an automotive power steering system, comprising:

a pump housing including at least two discrete housing sections, including a first cast housing section provided with a substantially planar wear surface, and a second cast housing section provided with an integral pressure plate having a substantially planar wear surface;

means for removably joining the housing sections together as a one-piece housing;

a pump drive shaft extending into the pump housing;

a cam ring, located within the pump housing, having a precision-machined inner surface of generally oval shape;

a rotor, generally disposed in a central location within the cam ring and mounted for rotation on the drive shaft, having a plurality of slots in which vanes may move while rotating in unison with the rotor;

a plurality of vanes, with one vane slidably arranged in each of the slots of the rotor so as to be able to bear against the inner surface of the cam ring during operation of the pump;

low pressure passage means within the pump housing, for delivering low pressure hydraulic fluid to two low pressure sectors of the cam ring located on opposite sides of the drive shaft; and high pressure passage means within the pump housing, for delivering high pressure hydraulic fluid discharging from two high pressure sectors of the cam ring located on opposite sides of the drive shaft, and wherein the integral pressure plate constitutes a semi-flexible wall portion which can bend in response to hydraulic forces generated by fluid behind the wall portion.

5. A pump as in claim 4, wherein the semi-flexible wall portion is thinner in certain locations than other locations in order to provide controlled bending in response to the hydraulic forces behind the wall portion, and wherein said low pressure passage means including smooth gently contoured passageways for even delivery of low pressure fluid.

6. A pump as in claim 4, further comprising:

first and second bearing means for supporting the drive shaft for rotation in a predetermined place within the pump assembly, and wherein the first and second bearing means are located on a side of the rotor opposite the second housing section.

7. A balanced vane hydraulic pump including a housing formed from three lightweight castings, comprising:

a pump housing including three discrete housing sections, namely a front housing section, a center housing section and a rear housing section, said center housing section including an integrally-formed cam ring having a precision-machined inner surface of generally oval shape;

means for removably joining the three housing sections together as a one piece housing;

a pump drive shaft extending through the front and center housing sections and having a coupling region in the vicinity of the center housing section;

a rotor generally disposed in a center location within the cam ring, and having a socket region for slidably receiving the coupling region of the drive shaft, and a plurality of slots in which vanes may move toward and away from the cam ring while rotating with the rotor;

a plurality of vanes, with one vane slidably arranged in each of the slots of the rotor so as to be able to bear against the inner surface of the cam ring during operation of the pump;

low pressure passage means within the pump housing for delivering low pressure hydraulic fluid to two low pressure sectors within the cam ring located on opposite sides of the drive shaft; and high pressure passage means within the pump housing for delivering high pressure hydraulic fluid discharging from two high pressure sectors within the cam ring.

8. A pump as in claim 7, wherein the integrally-formed cam ring has a generally cylindrical external configuration and is integrally connected to the central housing section.

9. A hydraulic pump as in claim 8, wherein the integrally formed cam ring is rigidly connected to the center housing section in at least three discrete locations, and wherein said low pressure passage includes smooth gently contoured passageways for delivery of low pressure fluid.

10. A hydraulic pump as in claim 9, wherein a first one of the connecting locations forms an arc of at least 45°, and wherein the second and third regions are located at least about 90° away from either side of the first connecting section.

11. A balanced vane hydraulic pump for use in an automotive power steering system, comprising:

a housing formed from three lightweight castings, including front, center and rear housing sections, with the central housing section having two substantially flat side surfaces and the front and rear housing sections each having a single corresponding, substantially flat, side surface which flushly abuts a respective one of the flat side surfaces of the center housing section, the central housing section having at least one chamber therein for low pressure hydraulic fluid;

fastening means, including at least three bolts, for removably joining the three housing sections together as a one-piece housing;

a pump shaft;

a cam ring located within the center housing section having a precision-machined inner surface of generally oval shape;

a rotor disposed within the generally oval inner surface of the cam ring and mounted for rotation with the pump shaft, and provided with several radially arranged slots in which vanes may move while rotating with the rotor;

a plurality of vanes, with one vane slidably arranged in each of the slots of the rotor so as to be able to bear against the inner surface of the cam ring during operation of the pump;

first and second bearing means located within the front housing for rotatably supporting the drive shaft, whereby all mechanical support for the pump shaft resides on one side of the rotor;

low pressure passage means, located within the pump housing in fluid communication with a low pressure inlet port, and arranged in a substantially balanced plurality of interconnected concourses and inlet window regions for substantially evenly delivering low pressure hydraulic fluid to four inlet window locations adjacent to low pressure sectors of the cam ring located on opposite sides of the cam ring, said low pressure means includes smooth gently contoured passageways for delivery of low pressure fluid to said inlet window region; and high pressure passage means arranged to interconnect four discharged window regions via elongated concourses to a high pressure outlet port.

12. A pump as in claim 11, wherein the front, center and rear housing sections are made from cast aluminum, and fastening means includes steel reinforcement means for increasing the torque which may be applied upon the bolts when tightening the housing sections together, and wherein said low pressure passage means provides balanced resistance of fluid flow.

13. A pump as in claim 11, wherein the rear housing section has an internal chamber and a semi-flexible wall portion between its chamber and the rotor, and wherein the internal chamber of the rear housing section is connected to the high pressure passage means such that the semi-flexible wall portion moves toward the rotor when high pressures are encountered during pump operation.

14. A balanced vane hydraulic pump having a high pressure outlet discharge port and low pressure inlet return port for use in a power steering system, comprising:

a pump housing, regulating valve means, located within the pump housing, for regulating flow of high pressure hydraulic fluid from the pump assembly to the high pressure outlet port and for diverting any excess flow back to a low pressure passage in fluid communication with the inlet port;

a pump drive shaft extending at least partially through at least the pump housing;

a cam ring supported in place within the pump housing and having a symmetrical precision-machined inner surface of generally oval configuration upon which outer ends of vanes ride, said cam ring being integral with said pump housing;

a rotor, centrally located within the oval of cam ring and mechanically driven by the drive shaft, having a plurality of substantially radially arranged slots in which vanes may reciprocate while rotating with the rotor;

a plurality of vanes, each vane being slidably arranged in a respective one of the slots of the rotor so as to be able to bear against the inner surface of the cam ring during operation of the pump assembly;

low pressure passage means, located within the pump housing, in fluid communication with the low pressure inlet port, and arranged in a substantially balanced plurality of interconnected concourses and inlet window regions, including smooth gently contoured passageways for delivery of low pressure hydraulic fluid to four inlet window locations adjacent to two low pressure sectors of the cam ring located on opposite sides of the drive shaft; and high pressure passage means, arranged as four discharge window regions interconnected by elongated concourses, for delivering high pressure hydraulic fluid discharging from four outlet window locations in two high pressure sectors of the cam ring to the regulating valve located on opposite sides of the drive shaft.

15. A balanced vane hydraulic pump for use in an automotive power steering system, comprising:

a pump housing including three discrete housing sections, namely a front housing section provided with a substantially planar wear surface, a center housing section provided with two substantially flat side surfaces parallel to one another and an interior chamber open at the two side surfaces, and a rear housing section provided with a substantially planar wear surface;

means for removably joining the three housing sections together as a one-piece housing;

a pump drive shaft extending substantially through at least the front housing section and center housing section and having a splined region in the vicinity of the center housing section;

a cam ring, located within the center housing section, having a precision-machined inner surface of generally oval shape upon which outer ends of vanes ride;

a rotor generally disposed in a central location within the cam ring, and having a splined socket region for slidably receiving the splined region of the drive shaft, and a plurality of radially arranged slots in which vanes may radially move while rotating in unison with the rotor;

a plurality of vanes, with one vane slidably arranged in each of the slots of the rotor so as to be able to bear against the inner surface of the cam ring during operation of the pump;

low pressure passage means, formed inside the pump housing for providing ports and concourses to deliver low pressure hydraulic fluid to four inlet window locations adjacent to two low pressure sectors of the cam ring located on opposite sides of the drive shaft, said low pressure passage means including a wishbone-shaped gallery located substantially within the central housing section and outside of the came ring, said wishbone gallery including smooth gently contoured passageways for delivery of low pressure fluid to said inlet window locations; and high pressure passage means, formed inside the pump housing, for providing ports and concourses to deliver high pressure hydraulic fluid discharging from four outlet window locations adjacent to two high pressure sectors of the cam ring located on opposite sides of the drive shaft.

16. A pump as in claim 15 further comprising an external reservoir for low pressure hydraulic fluid, and wherein the wishbone gallery includes a main concourse plumbed directly to the reservoir and two elongated concourses directly connected to and in broad fluid communication with the main concourse and respectively diverging from one another toward a respective one of the low pressure sectors of the cam ring.

17. A pump as in claim 16, wherein the portion of each elongated concourses of the wishbone gallery downstream from the main concourse diverge in longitudinal cross-section in order to enable smooth transitional delivery of low pressure hydraulic fluid to a pair of inlet window locations on opposite sides of the cam ring.

18. A pump as in claim 17, wherein:

the inlet window locations are formed by providing recessed inlet window regions in the internal side walls of the front and rear housing, and the elongated concourses of the wishbone gallery are formed at least in part by providing a sloped elongated region leading from the main concourse of the wishbone gallery to the recessed inlet window regions of the front and rear housings.

19. A pump as in claim 11, wherein the flat side surface of the rear housing section is stiff and does not flex in response to hydraulic forces within the rear housing section.

* * * * *

UNITED STATES PATENT AND TRADEMARK OFFICE

CERTIFICATE OF CORRECTION

PATENT NO. : 5,267,840

DATED : December 7, 1993

INVENTOR(S) : Snow et al.

It is certified that error appears in the above-identified patent and that said Letters Patent is hereby corrected as shown below:

Column 1, line 41, replace "poring" with --porting--.

Column 1, line 64-65, replace "arrows 82 & 84" with --82 & 84--.

Column 3, line 39, replace "pardon" with --portion--.

Column 5, line 24, replace "lines" with --line--.

Column 7, line 5, replace "21 30" with --21-30--.

Column 7, line 6, replace "steeling" with --steering--.

Column 7, line 13, replace "lines" with --line--.

Column 7, line 26, replace "1 90" with --190--.

Column 8, line 48, replace "partion" with --portion--.

Column 9, line 16, replace "poring" with --porting--.

Column 9, line 22, replace "poring" with --porting--.

Column 9, line 29, replace "shown" with --show--.

Column 9, line 48, replace "BBF" with --86F--.

Column 9, line 66, replace "h" with --it--.

Column 10, line 34, replace "342" with --343A--.

Column 10, line 59, replace "pardon" with --portion--.

Column 10, line 63, replace "low" with --flow--.

UNITED STATES PATENT AND TRADEMARK OFFICE

CERTIFICATE OF CORRECTION

PATENT NO. : 5,267,840

DATED : December 7, 1993

INVENTOR(S) : Snow et al.

It is certified that error appears in the above-identified patent and that said Letters Patent is hereby corrected as shown below:

Column 11, line 22, replace "or" with --of--.

Column 11, line 34, replace "10A" with --110A--.

Column 12, line 63, after "may" insert --be--.

In The Claim

Column 18, line 25, replace "came" with --cam--.

Signed and Sealed this

Fourteenth Day of March, 1995

*Attest:*

*Attesting Officer*

Bruce Lehman

BRUCE LEHMAN

*Commissioner of Patents and Trademarks*